US009766033B2

(12) United States Patent
Powell

(10) Patent No.: US 9,766,033 B2
(45) Date of Patent: Sep. 19, 2017

(54) STABILIZER SHOCK MOUNT

(71) Applicant: Marcus Powell, New London, IA (US)

(72) Inventor: Marcus Powell, New London, IA (US)

( * ) Notice: Subject to any disclaimer, the term of this patent is extended or adjusted under 35 U.S.C. 154(b) by 0 days.

(21) Appl. No.: 14/849,703

(22) Filed: Sep. 10, 2015

(65) Prior Publication Data

US 2016/0069633 A1 Mar. 10, 2016

Related U.S. Application Data

(60) Provisional application No. 62/048,347, filed on Sep. 10, 2014.

(51) Int. Cl.
*F41B 5/20* (2006.01)
*F41B 5/14* (2006.01)

(52) U.S. Cl.
CPC ..... *F41B 5/1426* (2013.01)

(58) Field of Classification Search
CPC ..... F41B 5/1426
USPC ..... 124/86, 88, 89
See application file for complete search history.

(56) References Cited

U.S. PATENT DOCUMENTS 3,412,725 A * 11/1968 Hoyt, Jr. ..... F41B 5/1426 124/84
3,524,441 A * 8/1970 Jeffery ..... F41B 5/1426 124/89
3,589,350 A * 6/1971 Hoyt, Jr. ..... F41B 5/1426 124/89
4,245,612 A * 1/1981 Finlay ..... F41B 5/14 124/89
4,779,602 A * 10/1988 Hess, Sr. ..... F41B 5/1426 124/88
4,907,567 A * 3/1990 Henrich ..... F41B 5/1426 124/23.1
4,955,356 A * 9/1990 Pike ..... F41B 5/1426 124/88
5,273,022 A * 12/1993 Leven ..... F41B 5/1426 124/88
5,339,793 A * 8/1994 Findley ..... F41B 5/1426 124/89
5,388,563 A * 2/1995 Hsu ..... F41B 5/1426 124/23.1
5,390,656 A * 2/1995 Villa ..... F41B 5/1426 124/89
5,595,169 A * 1/1997 Brown, Jr. ..... F41B 5/1426 124/89
5,669,370 A * 9/1997 Breedlove ..... F41B 5/1426 124/89
6,021,770 A * 2/2000 Sodaro ..... F41B 5/1426 124/86
6,431,163 B1 * 8/2002 Chipman ..... F41B 5/1426 124/89

(Continued)

*Primary Examiner* — Alexander Niconovich
(74) *Attorney, Agent, or Firm* — Shuttleworth & Ingersoll, PLC; Brett Papendick

(57) ABSTRACT

A stabilizer shock mount attachable to a bow stabilizer assists in quieting the stabilizer during the drawing of a bow and after the bow is fired. The stabilizer shock mount has a first end attachable to the bow and a second end attachable to the bow stabilizer. The stabilizer shock mount allows the bow stabilizer to flex such that the vibrations from the bow stabilizer will not be transferred back to the bow. Additionally, when drawing the bow, the stabilizer shock mount allows the bow stabilizer to achieve stillness more quickly.

18 Claims, 3 Drawing Sheets

(56) References Cited

U.S. PATENT DOCUMENTS 6,675,793 B1 * 1/2004 Saunders ..... F41B 5/1426 124/89
6,718,964 B1 * 4/2004 Graf ..... F41B 5/1426 124/89
6,802,307 B2 * 10/2004 Leven ..... F41B 5/1426 124/89
7,213,590 B2 * 5/2007 Pellerite ..... F41B 5/1426 124/89
8,220,448 B1 * 7/2012 Moggo ..... F41B 5/1426 124/89
8,365,713 B2 * 2/2013 Grace, Jr. ..... F41B 5/1426 124/89
8,573,193 B2 * 11/2013 Khoshnood ..... F41B 5/1426 124/86
8,590,522 B2 * 11/2013 Khoshnood ..... F41B 5/1426 124/86
8,695,580 B2 * 4/2014 LoRocco ..... F41B 5/1426 124/89
8,833,356 B2 * 9/2014 Khoshnood ..... F41B 5/1426 124/86
9,016,268 B2 * 4/2015 Leven ..... F41B 5/1426 124/89
9,038,618 B1 * 5/2015 Bomar ..... F41B 5/1426 124/86
9,097,487 B2 * 8/2015 Kempf ..... F41B 5/1407
2002/0020403 A1 * 2/2002 Troubridge ..... F41B 5/12 124/89
2008/0092868 A1 * 4/2008 Silverson ..... F41B 5/1426 124/86
2008/0236559 A1 * 10/2008 Barnard ..... F41B 5/10 124/89
2008/0264400 A1 * 10/2008 Wright ..... F41B 5/1426 124/89
2009/0000606 A1 * 1/2009 Cooper ..... F41B 5/1407 124/25.6
2010/0192931 A1 * 8/2010 Brewster ..... F41B 5/1407 124/89
2014/0267721 A1 * 9/2014 Stern ..... F41B 5/1492 348/143
2015/0184973 A1 * 7/2015 Martens ..... F41B 5/1426 124/23.1
2015/0316343 A1 * 11/2015 Simonds ..... F41B 5/1426 124/89

* cited by examiner

STABILIZER SHOCK MOUNT

CROSS-REFERENCE TO RELATED APPLICATIONS

The present application claims priority to provisional patent application 62/048,347 which was filed on Sep. 10, 2014, and is hereby expressly incorporated by reference in its entirety.

BACKGROUND OF THE INVENTION

In the bow and arrow industry, bow stabilizers serve to steady the bow and reduce force on the bow and the user of the bow. Typically they extend at a perpendicular to the strings of the bow. Various shapes and sizes have been utilized by users due to certain effects generated by the stabilizer as well as overall comfort to the user.

The main body of stabilizers typically consists of a solid piece of material shaped like a tube. In the past, many stabilizer bodies were made out of metal, although the weight distribution of most metal stabilizers tend to be less than ideal and too heavy for certain applications. Currently, most stabilizers are made using lighter materials such as carbon, ABS plastic and similar materials to make stabilizer bodies as light and rigid as possible.

A first end of the stabilizer typically is threaded and can be screwed directly into the bow. A second end of the stabilizer includes a dampening device and a weight. The material of the dampening component is usually a type of rubber, gel or sand. As vibration must be transferred properly away from the bow and out of the stabilizer end, the normal practice is to place the dampening component away from the bow end of the stabilizer and toward the portion of the unit furthest away from the bow and after the main body. The weight can be found on the far side of the second end after the rubber material at the end of the stabilizer where it is furthest from the bow. The weight serves as a counterbalance, and it helps stabilize the bow when being shot.

The dampening component separates the main body of the stabilizer from the weight. When a bow is shot with a stabilizer, vibration is cancelled out due to the weighted end oscillating at a different frequency than the rest of the stabilizer and bow.

Regardless of the shape and size of the stabilizer, the stabilizer is itself subject to forces as it is mounted in some fashion to the bow and this phenomenon causes problems when aiming the bow and after the bow has been fired.

It is therefore an object of the present invention to provide a stabilizing device to a bow stabilizer.

SUMMARY OF THE INVENTION

A stabilizer shock mount provides vibration reduction for an existing bow stabilizer or a new bow stabilizer with the stabilizer shock mount. The addition of the stabilizer shock mount also steadies the bow when drawing the bow and/or after the bow is fired.

The stabilizer shock mount has an outer tube serving as a housing for several parts including a shock reducer element, a washer, a bushing and an inner member. The outer tube is primarily hollow and has a female end for receiving a screw from a typical bow stabilizer. Additionally, the stabilizer shock mount reduces the vibrations in the bow after the bow has been utilized for firing.

As the screw from the bow stabilizer enters the outer tube, it then enters an internally threaded cover or screw cap which in turn is held by a portion of an inner member. A washer or ring surrounds a portion of the screw cap and also abuts the shock reducer element. The farther the screw is positioned into the screw cap, the greater the force on the washer and also the shock reducer element. The shock reducer element is preferably made of a flexible material like rubber and the force from the washer pushes the external wall of the shock reducer element against the inner wall of the housing. Accordingly, the stabilizer is held tightly within the tube and one end of the shaft.

The opposite side of the tube has a bushing that is positioned between a portion of the inner member and the internal wall of the outer tube. A groove on the bushing creates a partial gap between the outer wall of the bushing and the outer tube. When the tube is threaded onto a bow, the gap allows the shaft to flex for a limited range. Alternatively, the stabilizer shock mount can be attached solely to the bow without the addition of the bow stabilizer.

DETAILED DESCRIPTION

Figure 1:
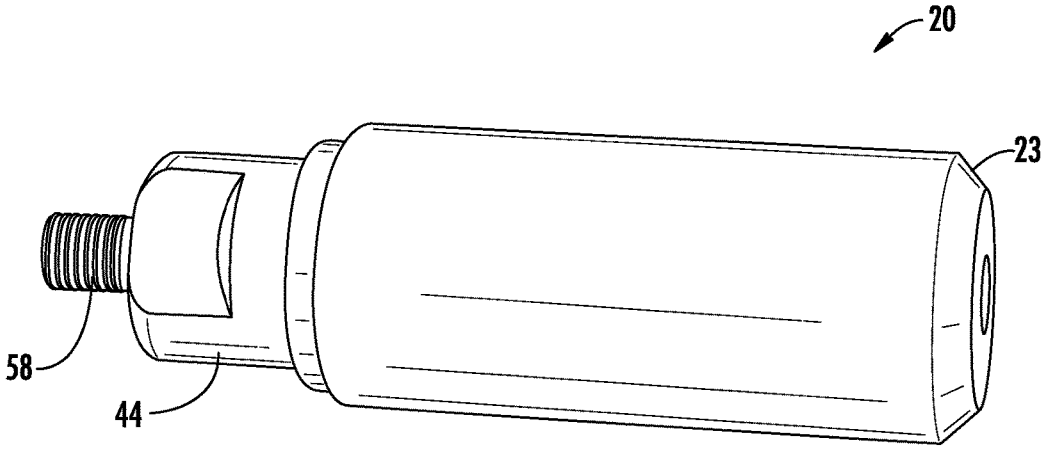
FIG. 1 is a perspective view of a stabilizer shock mount.
Figure 2:
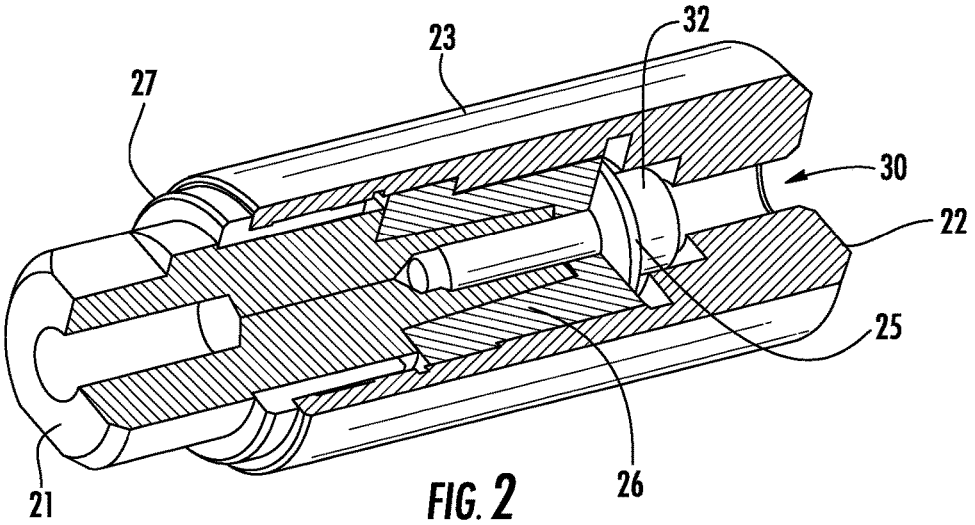
FIG. 2 is a partial cross sectional view of the stabilizer shock mount.
Figure 3:
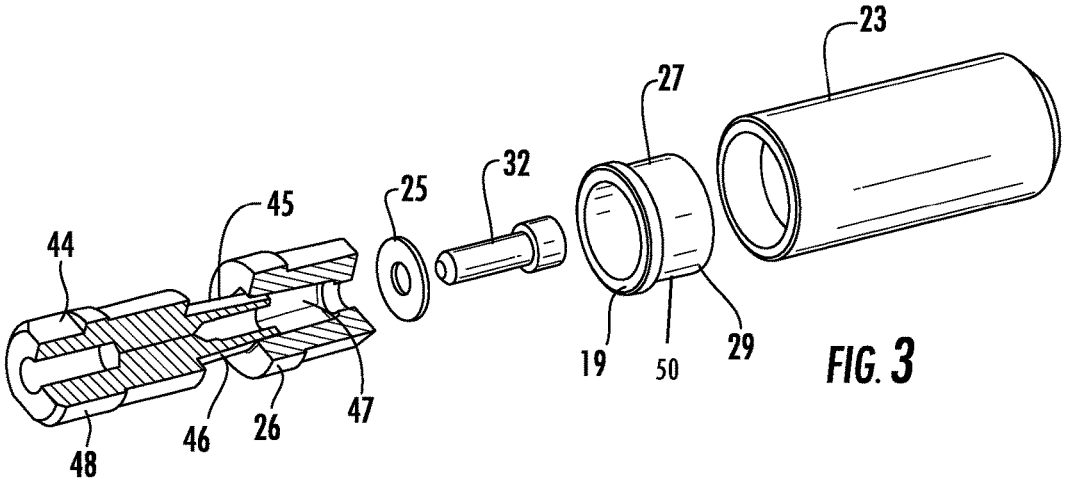
FIG. 3 is an exploded view of the stabilizer shock mount wherein the bushing and the inner member are shown in partial cross section.
Figure 4:
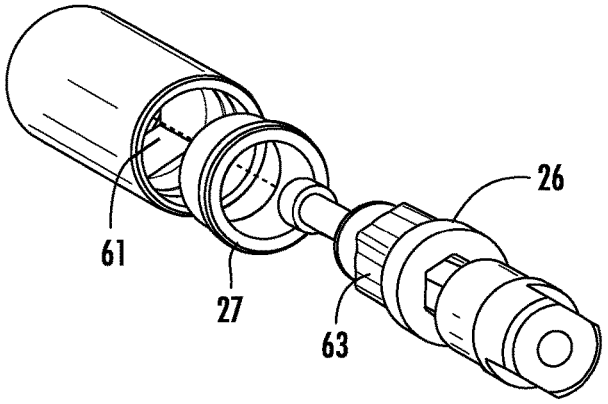
FIG. 4 is a partially exploded view of the stabilizer shock mount.
Figure 5:
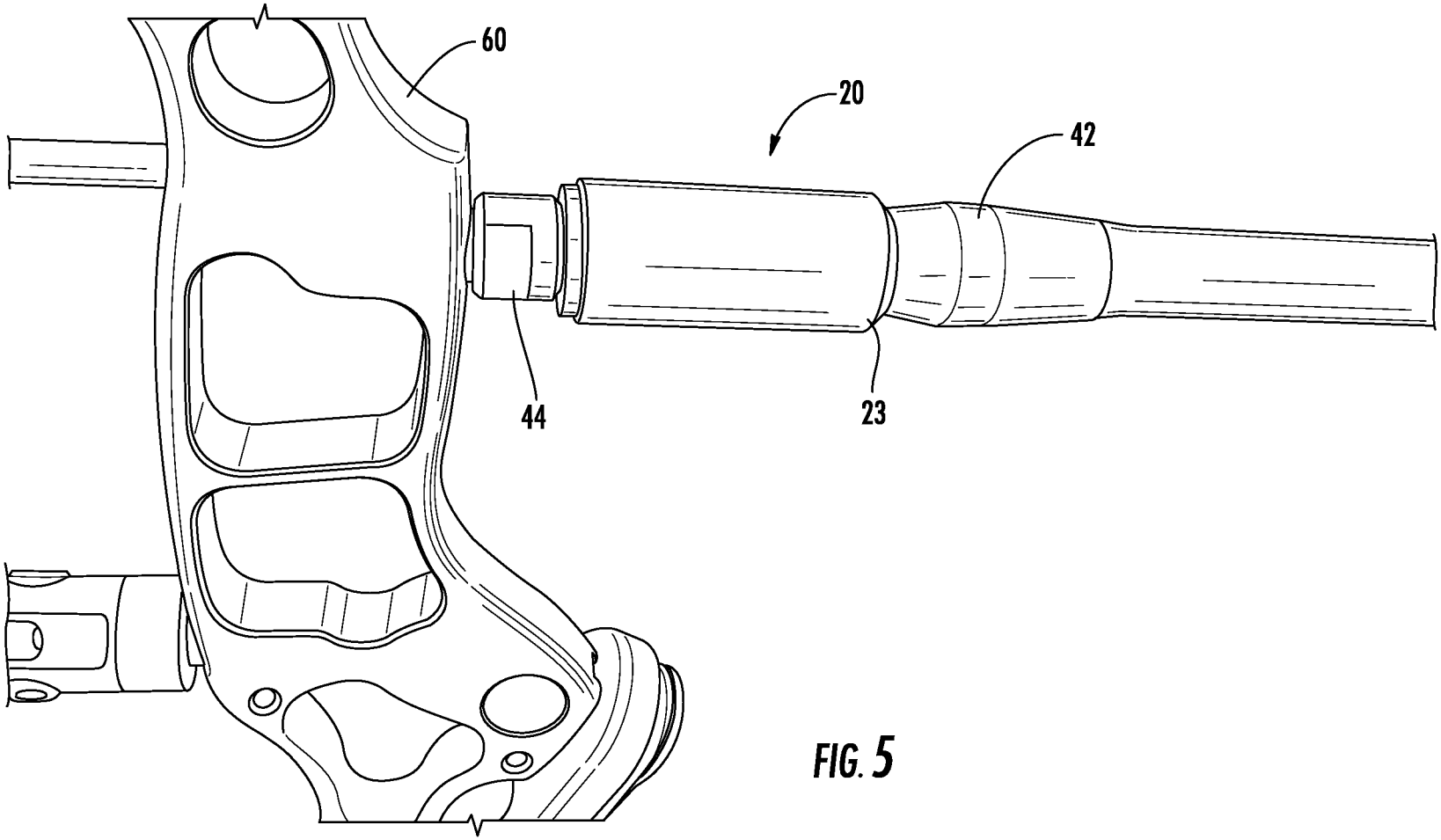
FIG. 5 is the stabilizer shock mount attached to a bow stabilizer and a bow.

Now referring to the drawings, a stabilizer shock mount 20 is shown in FIGS. 1-4. The stabilizer has a first end 21 and second end 22. An outer tube 23 serves as a housing for a shock reducer 26, a ring 25, a bushing 27, and a screw cap 32. The second end 22 has an opening 30 preferably with a threaded portion to receive a portion of a typical bow stabilizer 42. The farther the portion of the bow stabilizer 42 is threaded into the opening 30 and into the screw cap 32 the greater the force on the ring 25 and the shock reducer 26.

The first end 21 is attachable to a bow 60 via threaded end 58. The bushing 27 is on an outside of an inner member 44. A flat portion 50 on the bushing 27 creates a partial gap between an outer wall of the bushing 27 and the outer tube 23. The gap allows the inner part to flex within the outer tube 23 for a limited range. The bushing 27 is preferably made of nylon and the shock reducer 26 is preferably made of a rubber product.

In the preferred embodiment, the parts and their relationship to one another can be demonstrated by describing how the parts are assembled. The inner member 44 comprises a first section 46 and a second section 48. The first section 46 extends from the second section 48 and has a smaller width than the second section 48. At least a portion of the first section 46 is hollow and at least a portion of the second section is hollow. The first section 46 preferably has a shape that allows it to mate with the shock reducer 26 and prevent rotation between the shock reducer 26 and the inner member 44. In the preferred embodiment, an exterior wall 45 of the first section 46 is hexagonal in shape. Similarly, an inside wall 47 of the shock reducer 26 is a corresponding hexagonal shape. As the inner member 44 is slid into the shock reducer 26, the first section 46 is covered by the shock reducer 26.

The bushing 27 is preferably circular and has a first end 19 that is greater in diameter than the second end 29 of the shock reducer 24. The bushing 27 is slid over the first section 46 of the inner member 44 and over the shock reducer 26.

The ring 25 is a bearing element and can be a washer and abuts the shock reducer 26 such that a screw cap 32 can be fitted through an opening of the ring 25 and the screw cap 32 can be fitted through the inner member 44 and the shock reducer 26. Finally, the outer tube 23 is fitted over the screw cap 32, shock reducer 26, at least part of the bushing 27 and at least part of the inner member 44. An inner wall 61 of the outer tube 23 is shaped to correspond to the shape of an outer wall 63 of the shock reducer 26. Preferably the shapes are hexagonal and once the outer tube 23 is positioned over the shock absorber 26, the hexagonal shapes prevent the shock reducer 26 and outer tube 23 from rotating relative to one another. The second end 29 of the bushing 27 is positioned between the outer tube 23 and the inner member 44 and maintains the alignment between the inner member 44 and the outer tube 23.

Once assembled, a threaded member 58 attached to the first end 21 can be attached to a bow 70. The stabilizer shock mount 20 can then be screwed onto the bow stabilizer 42. A screw of the bow stabilizer 42 enters the opening 30 and then the screw cap 32. The farther the bow stabilizer 42 is threaded into the screw cap 32, the more force is maintained on the ring 25 and the shock reducer 26. As the shock reducer 26 is held in place longitudinally by the inner member 44 and the ring 25, the increased force on the shock absorber 26 translates to an expansion outwardly. The greater the shock absorber expands, the more force is exerted by the shock reducer 26 on the outer tube 23. Accordingly, the preferred stiffness of the shock reducer can be set by a user of the stabilizer shock mount 20 by screwing the mount 20 to a particular location on the bow stabilizer 42.

Another embodiment can be achieved by making a bow stabilizer with the stabilizer show mount as one piece.

Having thus described the invention in connection with the several embodiments thereof, it will be evident to those skilled in the art that various revisions can be made to the several embodiments described herein with out departing from the spirit and scope of the invention. It is my intention, however, that all such revisions and modifications that are evident to those skilled in the art will be included with in the scope of the following claims. Any elements of any embodiments disclosed herein can be used in combination with any elements of other embodiments disclosed herein in any manner to create different embodiments.

What is claimed is:

1. A stabilizer shock mount for a bow stabilizer, comprising:
- a first end;
- a second end;
- wherein the first end is attachable to a bow;
- wherein the second end is attachable to a bow stabilizer;
- a housing;
- an inner member;
- the inner member at least partially contained within the housing;
- a bushing;
- the bushing having a longitudinal axis;
- the bushing has a first side running a length of the longitudinal axis;
- the bushing has a flat portion on the first side;
- an external wall of the first side of the bushing abuts an internal wall of the housing except at the flat portion wherein the inner member can flex within the housing;
- a shock reducer;
- whereby the bushing maintains the inner member in a first position and whereby the shock reducer is positioned between the inner member and the housing;
- wherein a location of the shock reducer relative to the bow stabilizer determines a stiffness of the stabilizer shock mount.

2. The stabilizer shock mount of claim 1, wherein:
- the inner member selectively attachable to the shock reducer.

3. The stabilizer shock mount of claim 1, wherein:
- the inner member has a first section and a second section;
- the first section has a width less than the second section.

4. The stabilizer shock mount of claim 3, wherein:
- the housing has an internal wall;
- the shock reducer has an outer wall;
- whereby the outer wall of the shock reducer abuts the internal wall of the housing when the device is attached to the bow stabilizer.

5. The stabilizer shock mount of claim 4, wherein:
- the housing and the shock reducer have a complimentary shape to prevent rotation of the housing relative to the shock reducer.

6. The stabilizer shock mount of claim 5, wherein:
- the first section of the inner member has an external wall complimentary in shape to an inner wall of the shock reducer.

7. The stabilizer shock mount of claim 6, wherein:
- the first section has a first circumference;
- the second section has a second circumference;
- the first circumference is less than the second circumference.

8. The stabilizer shock mount of claim 7, further comprising:
- a threaded member attached to the inner member;
- whereby the threaded member is attachable to a bow.

9. The stabilizer shock mount of claim 8, further comprising:
- the shock reducer is made of a flexible material.

10. The stabilizer shock mount of claim 9, wherein:
- the shock reducer is made of rubber.

11. The stabilizer shock mount of claim 10, wherein:
- the first section of the inner member is secured by the shock reducer;
- the second section of the inner member is secured by the bushing whereby the bushing is positioned to allow a limited range of movement of the second section within the housing.

12. A vibration reducer for a bow stabilizer, comprising:
- a first end;
- a second end;
- wherein the first end is attachable to a bow;
- wherein the second end is attachable to the bow stabilizer;
- a housing;
- the housing has an internal wall;
- an inner member;
- the inner member at least partially contained within the housing;
- a bushing;
- a shock reducer element;
- the inner member comprising a first section and a second section;
- the bushing having a longitudinal axis;

the bushing has a first side running a length of the longitudinal axis;

the bushing has a flat portion on the first side;

an external wall of the first side of the bushing abuts the internal wall of the housing except at the flat portion wherein the inner member can flex within the housing;

whereby the bushing maintains the second section in a selectively movable first position and whereby the shock reducer element is positioned between the first section and the housing.

13. The vibration reducer of claim 12, further comprising:

a bearing element;

the bearing element adjacent the shock reducer element;

whereby a force against the bearing element will cause the shock reducer element to compress and the shock reducer element will expand outwardly.

14. The vibration reducer of claim 13, wherein:

a gap is formed between the flat portion and the internal wall of the housing thereby allowing at least a portion of the inner member to move when force is applied to a portion of the inner member.

15. The vibration reducer of claim 14, wherein:

the first section has a first circumference;

the second section has a second circumference;

the first circumference is less than the second circumference.

16. The vibration reducer of claim 15, wherein:

the shock reducing element is made of a flexible material.

17. The vibration reducer of claim 16, further comprising:

a threaded member attached to the second section of the inner member.

18. A stabilizer shock mount, comprising:

a first end;

a second end;

wherein the first end is attachable to a bow;

a bow stabilizer attached to the second end;

an outer tube;

the outer tube has an internal wall;

an inner member;

the inner member at least partially contained within the outer tube;

the inner member having a first section and a second section;

a shock reducer element selectively attachable to the first section;

a bushing between the second section and the outer tube wherein the bushing maintains a particular alignment between the outer tube and the second section;

an internal wall of the outer tube and an external wall of the shock reducer have a complimentary shape to prevent rotation of the outer tube relative to the shock reducer;

the first section of the inner member has an external wall complimentary in shape to an inner wall of the shock reducer to prevent rotation of the first section relative to the shock reducer;

a threaded screw cap wherein a screw from the bow stabilizer can be inserted;

whereby the farther the screw is threaded into the screw cap the shock reducer expands outwardly and increases a stiffness of the stabilizer shock mount.

* * * * *